United States Patent [19]

Schroeder

[11] 4,354,316

[45] Oct. 19, 1982

[54] METHOD OF BENEFICIATING WOOD

[76] Inventor: Herbert A. Schroeder, 3000 W. Lake St., Fort Collins, Colo. 80521

[21] Appl. No.: 295,366

[22] Filed: Aug. 24, 1981

[51] Int. Cl.[3] ..... F26B 7/00; F26B 5/04; F26B 3/00

[52] U.S. Cl. ..... 34/13.8; 34/9.5; 34/16.5; 428/541

[58] Field of Search ..... 34/9.5, 13.4, 13.8, 34/16.5; 428/541

[56] References Cited

U.S. PATENT DOCUMENTS 3,342,629 9/1967 Martin ..... 34/9.5

3,900,957 8/1975 Denton et al. ..... 34/16.5

*Primary Examiner*—John J. Camby

*Attorney, Agent, or Firm*—Bruce G. Klaas; Jerry W. Berkstresser

[57] ABSTRACT

Wood is beneficiated by treating the wood with an agent capable of forming a borate ester linkage between hydroxyl groups of the cell wall constituents of the wood, and thereafter treating the wood with an aldehyde to effect aldehyde cross-linking of cell wall structural constituents of the wood. Suitable borate ester forming agents include boric acid, lower polyalkyl borate esters, mono- and di-substituted derivatives of boric acid and/or the borate esters, and compounds capable of forming these agents in situ under the prevailing reaction conditions.

21 Claims, No Drawings

METHOD OF BENEFICIATING WOOD

BACKGROUND AND SUMMARY OF THE INVENTION

This invention relates to methods of beneficiating wood, and more particularly to methods of effecting dimensional stability and other desired properties in wood through aldehyde cross-linking of cell wall structural constituents of the wood.

Many problems in the effective utilization of wood arise from physical shrinking and swelling due to variations in moisture content below the fiber saturation point of the wood. Seasonal variations in ambient humidity commonly lead to seasonal cycles of shrinking and swelling of wood and wood products. In a similar manner, the movement of wood products between regions of varying humidity commonly results in shrinking or swelling of the wood. This dimensional instability of wood can result in serious physical problems in wood products, such as cracking and/or warping of the wood, unacceptable size variations in doors, windows, and drawers, and the like, as well as surface problems such as surface checking, grain raising, and the like. In addition to the foregoing, wood is subject to fungal decay and insect damage, both of which effectively limit the expected useful life of wood products in various regions.

In the past, various wood preservatives have been employed to protect certain desirable properties of wood products. However, commonly used wood preservatives, such as creosote and pentachlorophenol, have associated environmental toxicity, flammability, odor, color and handling problems which severely limit their desirability in many applications. Wood products are also commonly protected against the effects of contact with surface moisture by applying a vapor barrier, such as paint, varnish or oil, on the surface of the wood. Although being relatively effective in protecting the wood surface against immediate weather degradation, it has been found that vapor barriers afford little or no protection against long-term effects, such as ambient humidity variations.

In order to overcome the foregoing problems, many attempts have been made to impart dimensional stability to wood and wood products, primarily through bulking, reducing the affinity of wood for moisture, or limiting the accessibility of wood to moisture by effecting cross-linking of cell wall structural constituents of the wood.

Bulking implies swelling of wood to its maximum dimension and retaining the wood at that dimension by depositing a bulking agent, such as polyethylene glycol, in the wood cell wall and in the cell cavity. Diffusion of the bulking agent from the cavity or lumen into the cell wall is typically a slow process, often requiring several days for adequate treatment. In addition, as much as 30% or more of a bulking agent by weight of dry wood, is frequently considered to be a minimum acceptable level for most practical applications. For these reasons, bulking is often an economically prohibitive means of attaining dimensional stabilization of wood. The resulting wood product also has been found to have relatively low strength properties on the order of those normally associated with green wood.

The affinity of wood for moisture can be reduced, and dimensional stability can be improved, by chemically modifying a substantial number of hydroxyl groups associated with the cell wall to substantially reduce hydrogen bonding with water. For example, acetylation of the hydroxyl groups can be obtained by treating wood with acetic anhydride in the gaseous state at elevated temperatures with either pyridine as a catalyst or xylene as a carrier solvent. It has been found, however, that the high cost of chemicals employed, and associated equipment corrosion problems, often makes acetylation an economically prohibitive dimensional stabilization alternative.

It is also known in the art that dimensional stabilization of wood may be obtained by using formaldehyde as a cross-linking agent to form methylene bridges between the hyroxyl groups of the wood carbohydrate polymers. Formaldehyde cross-linked wood has been shown to exhibit greatly improved dimensional stability properties over those associated with untreated wood. However, in prior art cross-linking processes, acid catalysts have been required to promote the cross-linking reaction. In general, it has been known in the art that the more acidic the catalyst, the more complete the cross-linking reaction, and that relatively weak acids, such as acetic acid, have been ineffective to promote polymerization. Due to the highly acidic environment required in prior art aldehyde cross-linking processes, gains in dimensional stability have been made at the expense of other highly desirable physical properties of the wood, such as toughness, abrasion resistance, and other strength properties. For example, wood in which shrinking and swelling has been reduced by 60% through conventional, acid catalyzed formaldehyde cross-linking has been found to retain only 20–30% of its original toughness and 7% of its original abrasion resistance. The degradation of desirable wood properties through conventional acid catalyzed aldehyde cross-linking is thought to result from acid induced hydrolysis of the wood carbohydrates, particularly hemicelluloses, which are of structural importance in the wood. The accompanying loss in desirable wood properties has severely limited the commercial acceptability of conventional aldehyde cross-linking processes for the stabilization of wood, and given rise to a recognized need for an entirely different method of cross-linking which will form stable reaction products without the use of degradative catalysts.

It has now been determined that the foregoing problems can be overcome and wood can be effectively and economically beneficiated by treating the wood with an agent capable of forming a borate ester linkage between hydroxyl groups of the cell wall constituents of the wood, and thereafter treating the wood with an aldehyde to effect aldehyde cross-linking of cell wall structural constituents of the wood without obtaining a substantial degradation of desirable wood properties, such as toughness and abrasion resistance. Cross-linking is obtained in the absence of an acid catalyst in the sense of conventional acid catalyzed aldehyde cross-linkage reactions. Rather, it appears that the agent forms an intermediate boric acid ester cross-linkage between free hydroxyl groups in the wood cell wall structural constituents, which is subsequently displaced by an alkyl cross-linkage upon subsequent treatment of the wood with an aldehyde.

DESCRIPTION OF THE PREFERRED EMBODIMENTS

It is contemplated that all varieties of wood may be beneficiated by treatment according to the present invention, although it will be apparent that the degree of cross-linking obtained and optimum treatment conditions, and therefore the degree of beneficiation, will be dependent upon many characteristics of the wood being treated, such as wood type, density, sample size and the like.

The wood is initially treated with a suitable agent capable of forming a borate ester intermediate linkage between hydroxyl groups of the cell wall constituents of the wood. Preferably, the borate ester linkage is a polyester linkage generally of the form:

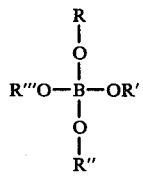

wherein at least two of R, R′, R″ and R‴ are moieties found principally in the wood cell cellulose, hemicellulose and lignin constituents, and the remaining of R, R′, R″ and R‴ are selected from the group consisting of hydrogen, lower alkyl and the cellulose, hemicellulose or lignin moieties. Suitable borate ester forming agents include boric acid, lower polyalkyl borate esters such as trimethyl borate, $B(OCH_3)_3$, and triethyl borate, $B(OCH_2CH_3)_3$, and mono- or di-substituted derivatives thereof. Other suitable borate ester forming agents include compounds which are capable of forming boric acid, lower alkyl borate esters, or mono- or di-substituted derivatives thereof in situ under the prevailing reaction conditions.

The wood may be treated to form the borate ester linkage by contacting the wood with the borate ester forming agent in a liquid phase, such as by submerging the wood in an aqueous solution of the agent, by applying a liquid coating of the agent onto the surface of the wood, or the like, and then allowing the agent to penetrate into the wood. Alternatively, the wood may be treated to form the borate ester linkage by contacting the wood with the borate ester forming agent in a vapor phase, or in a combination of liquid and vapor phases.

When wood is treated with the borate ester forming agent in a liquid phase, an aqueous solution of boric acid is one presently particularly preferred agent of choice due to its availability and relatively low cost. It is to be understood, however, that lower akyl borate esters may be employed in a liquid phase for this purpose. A sufficient amount of the borate ester forming agent is employed to allow an amount of the agent to penetrate into the wood sufficient to provide an amount of borate ester in the wood to react with at least a portion of the aldehyde upon subsequent aldehyde treatment. To facilitate penetration of the liquid agent into the wood, a vacuum may be applied to the wood, either before or after contact with the agent, followed by subjecting the wood to increased pressure levels while the wood is in contact with the aqueous solution. Sufficient contact times will depend on many factors, including the nature and size of wood being treated, the nature and concentration of the agent, the degree of ultimate cross-linking desired, and other factors. It has been generally found, however, that contact times on the order of about 1 minute to about 30 hours or more, more preferably about 5 minutes to about 5 hours, and most preferably about 10 minutes to about 2 hours, provide satisfactory results in most cases where the wood sample is being treated with an aqueous solution of boric acid and has a minimum dimension less than about six inches. Following contact with the aqueous solution, the wood is dried prior to subsequent aldehyde treatment, preferably to a moisture content of less than about 25% by weight, more preferably less than about 20% by weight, and most preferably less than about 10% by weight.

When the wood is treated with the borate ester forming agent in the vapor phase, the lower polyalkyl borate esters are the presently particularly preferred agents of choice due to their relatively higher volatility than that of boric acid, with trimethyl borate ester, $B(OCH_3)_3$, being the presently most preferred agent of choice. The wood may be contacted with the borate ester forming agent in the vapor phase by placing the wood and an open container of the agent in a closed vessel, including a vacuum in the vessel and then heating the vessel to a sufficient temperature level to vaporize the agent, such as from about 60° to about 140° C., and more preferably from about 110° to about 130° C. Alternatively, the wood may be placed in a closed vessel and a gas stream comprising the agent in the vapor phase may be injected into the vessel, or the wood may be contacted with the vapor by other suitable means. In any event, the wood is contacted with the agent in the vapor phase for a sufficient period of time to allow the vapor to penetrate the wood and form a sufficient amount of the borate ester in situ to provide the desired degree of cross-linking upon subsequent aldehyde treatment. Effective contact times with the vapor phase of the agent will again depend upon many factors, but it has been found that contact times on the order of about 5 minutes to about 5 days, more perferably about 10 minutes to about 3 days and most preferably about 30 minutes to 50 hours are generally effective for most purposes.

The wood may also be treated with the borate ester forming agent in both the liquid and vapor phases, such as by submersing the wood in the agent, e.g., trimethyl borate ester, in the liquid phase and then heating the wood to vaporize the agent, or by any other means capable of rendering the agent available in situ for formation of the desired borate ester intermediate constituents.

After treatment of the wood to form the borate ester linkage between hydroxyl groups of the wood cell constituents, the wood is contacted with an aldehyde to obtain aldehyde cross-linking of the wood.

As used herein, the term aldehyde includes any aldehyde capable of reacting in situ to obtain cross-linking of the wood. Suitable aldehydes include the lower aldehydes, such as formaldehyde and acetaldehyde, although other effective aldehydes may be useful for this purpose. The term aldehyde also includes any compound or precursor capable of reacting in situ under the prevailing reaction conditions to form a desired aldehyde, such as paraformaldehyde. The presently most particularly preferred aldehyde for use in connection with the inventive concepts is formaldehyde, due to its high degree of effectiveness, ready availability and low cost.

The wood, having a relatively low moisture content, such as below about 25% by weight, more preferably below about 20% by weight, and most preferably below about 10% by weight, is preferably contacted with the aldehyde in a vapor phase. As with the borate ester forming agent treatment, this may be accomplished by placing the wood and an open container of the aldehyde in a closed vessel and then raising the temperature to a level effective to vaporize at least a portion of the aldehyde in the container. Alternatively, the wood may be contacted with the aldehyde vapor by placing the wood in a closed vessel and then injecting the aldehyde vapor into the vessel, or by other suitable means for effecting contact between the wood and the aldehyde vapor.

The wood is contacted with a sufficient amount of aldehyde vapor at a sufficient temperature level and for a sufficient time effective to obtain aldehyde cross-linking of at least a portion of the borate ester linkage sites in the wood. When the wood is contacted with the aldehyde vapor by placing the wood and an open container of the aldehyde in a closed vessel and then heating the vessel, it is preferable to raise the temperature in the vessel to about 60° to about 140° C., more preferably to about 100° to about 135° C. and most preferably to about 110° to about 130° C. Effective contact times may range from about 5 minutes to about 50 hours or more, more preferably about 1 hour to about 40 hours, and most preferably about 10 hours to about 35 hours.

Although the precise molecular interaction is not fully understood at this time, it is believed that the aldehyde replaces the intermediate borate ester linkage in a mechanism analogous to that of transesterification. Therefore, when the pretreated wood is contacted with formaldehyde, for example, the relatively less stable borate ester linkage is replaced with a relatively more stable methylene bridge, $—CH_2—$, to obtain relatively more permanent cross-linking of the wood cell constituents.

The treated wood can exhibit an anti-swelling efficiency (ASE), or reduction in physical dimension swelling as compared to a comparative untreated sample, on the order of 50% or more.

It has been determined that wood treated in accordance with the inventive concepts is significantly beneficiated and exhibits a relatively high degree of dimensional stabilization, without suffering the high degree of strength loss normally associated with acid catalyzed cross-linking reactions.

After the wood has been treated with aldehyde, it may additionally be treated to remove any excess, unreacted reagents, e.g., by exhaustive leaching of the wood in a suitable liquid, such as water; by supplementary heating of the wood, such as to a temperature on the order of 105° C. for a period on the order of 48 hours in a ventilated forced air oven; by contacting the wood with an effective organic solvent vapor, such as toluene vapor for a period of time on the order of 12 hours; or by other suitable means known in the art.

In addition, other beneficial properties of the wood, such as decay resistance, coatability and other properties have been found to be substantially enhanced.

The following examples are presented for purposes of illustration only, and are not intended to limit the scope of the inventive concepts.

EXAMPLE 1

Wood block samples having a size of 5 cm in the radial and tangential directions and 1½ cm in the longitudinal, or fiber, direction are prepared from lodgepole pine heartwood which has been air dried to a moisture content of about 5% by weight.

An azeotropic mixture of trimethyl borate and methyl alcohol is prepared according to the procedure of Schlesinger, et al., "Procedures for the Preparation of Methyl Borate," *J. Am. Chem. Soc.* 75:213–215 (Jan. 5, 1953), by adding boric acid to methyl alcohol to form a reaction mixture, and then distilling the mixture to obtain an azeotrope containing about 73% by weight trimethyl borate and 27% by weight methyl alcohol, which boils at 54° C. An evaporating dish containing an amount of the azeotropic mixture of about 15% by weight of the dry wood samples is placed in an autoclave. The wood samples are then placed on a screen over the trimethyl borate mixture. The autoclave is closed and a vacuum is applied to the autoclave until a constant pressure gauge reading is obtained. The autoclave is then heated to the temperature levels indicated in Table I for the total times indicated in Table I. The autoclave is allowed to cool to ambient temperature, whereat any excess trimethyl borate ester is removed and any residual vapors are flushed from the autoclave.

An evaporating dish containing an amount of paraformaldehyde of about 15% by weight of the dry wood samples is then placed in the autoclave under the screen supporting the wood samples. The autoclave is again closed and a vacuum is applied until a constant pressure gauge reading is obtained. The autoclave is heated to the temperature levels indicated in Table I for the total times indicated in Table I. The autoclave is then again allowed to cool to ambient temperature, whereat any excess paraformaldehyde is removed and residual vapors are flushed from the autoclave.

The treated wood samples are exhaustively leached with running water, weighed and measured by micrometer to determine the net weight gain and anti-swelling efficiency (ASE) obtained, as an indication of dimensional stabilization. ASE is defined as the percentage of total volumetric swelling reduction obtained after treatment as compared to a matched control, when the samples are submerged in water under vacuum for a period of twenty-four hours.

The results are shown in the following Table I:

TABLE I

| Treatment | | | | | |
|---|---|---|---|---|---|
| Trimethyl Borate | | Paraform-aldehyde | | Net | |
| Time (Hours) | Temp. (°C.) | Time (Hours) | Temp. (°C.) | Weight Gain (%) | ASE (%) |
| 8 | 80 | 8 | 110 | 2.1 | 28.6 |
| 8 | 110 | 12 | 120 | 2.6 | 38.3 |
| 12 | 60 | 12 | 120 | 2.1 | 25.8 |
| 12 | 90 | 12 | 120 | 2.8 | 29.0 |
| 12 | 120 | 12 | 120 | 3.6 | 41.0 |
| 16 | 80 | 8 | 110 | 3.3 | 35.1 |
| 16 | 120 | 16 | 110 | 3.7 | 40.1 |
| 18 | 80 | 12 | 110 | 2.8 | 31.3 |
| 18 | 110 | 18 | 110 | 3.9 | 39.8 |
| 24 | 80 | 16 | 110 | 3.4 | 38.3 |
| 24 | 80 | 24 | 120 | 3.9 | 43.0 |
| 24 | 100 | 16 | 100 | 3.2 | 37.9 |
| 24 | 100 | 24 | 120 | 4.1 | 49.0 |
| 24 | 120 | 16 | 110 | 3.9 | 47.2 |
| 24 | 120 | 24 | 120 | 4.4 | 53.0 |
| 30 | 90 | 18 | 110 | 4.0 | 45.3 |
| 30 | 90 | 30 | 110 | 4.1 | 48.6 |
| 30 | 110 | 18 | 110 | 3.8 | 51.8 |
| 30 | 110 | 30 | 130 | 4.9 | 50.7 |
| 30 | 120 | 18 | 120 | 4.6 | 53.0 |
| 30 | 120 | 30 | 130 | 5.4 | 58.0 |
| 30 | 130 | 18 | 130 | 4.2 | 52.6 |

TABLE I-continued

| Treatment | | | | | |
|---|---|---|---|---|---|
| Trimethyl Borate | | Paraform-aldehyde | | Net | |
| Time (Hours) | Temp. (°C.) | Time (Hours) | Temp. (°C.) | Weight Gain (%) | ASE (%) |
| 30 | 130 | 30 | 130 | 4.4 | 52.2 |

EXAMPLE II

The procedure of Example I is repeated except that neat trimethyl borate is used in place of the trimethyl borate/methyl alcohol azeotropic mixture. Similar results are obtained.

EXAMPLE III

The procedure of Example I is repeated using wood samples of the species shown in Table II at a maximum treatment temperature of 120° C. and a total treatment time of 30 hours for both the trimethyl borate treatment and the paraformaldehyde treatment. The results are shown in the following Table II:

TABLE II

| Species | Net Weight Gain (%) | ASE (%) |
|---|---|---|
| Lodgepole pine | 4.9 | 47.9 |
| Ponderosa pine | 4.6 | 51.1 |
| Douglas fir | 3.9 | 43.2 |
| True fir | 4.2 | 49.8 |
| Western hemlock | 4.7 | 52.0 |
| Engelmann spruce | 5.1 | 52.8 |
| Redwood (sapwood) | 4.8 | 48.1 |
| Aspen | 4.2 | 49.2 |
| Yellow birch | 4.9 | 53.4 |

EXAMPLE IV

The procedure of Example III is repeated except that the wood samples are initially treated by submersing the wood samples in a 90% of saturation aqueous boric acid solution, imposing a water aspirator vacuum on the aqueous solution for 45 minutes and then subjecting the aqueous solution to an increased pressure of 45 p.s.i.g. for 45 minutes. The samples are removed from the aqueous solution and air dried over a three week period to an equilibrium moisture content of 5% by weight. The wood samples are then subjected to the aldehyde treatment of Example III. Similar results are obtained.

EXAMPLE V

Wood block samples having a size of 2×2×28 cm. are prepared according to ASTM Standard D-143 from ponderosa pine, lodgepole pine and aspen which has been air dried to a moisture content of about 5% by weight.

The samples are treated according to the procedure of Example I for a period of 30 hours for each of the trimethyl borate and paraformaldehyde treatments at the temperatures indicated in Table III. A set of match samples is heated to the same temperatures for a period of 30 hours for purposes of comparison. A matched, but untreated, set of controls, the heat treated samples and the aldehyde treated samples are then tested for toughness according to ASTM D-143. The results, shown as a percentage of the control samples (assumed to be 100%), are indicated in the following Table III:

TABLE III

| Species | Treatment Temp. (°C.) | Toughness (% of Control) | |
|---|---|---|---|
| | | Heat Treated | Aldehyde Treated |
| Ponderosa pine | 110 | 88 | 62 |
| Ponderosa pine | 120 | 63 | 54 |
| Ponderosa pine | 130 | 48 | 26 |
| Lodgepole pine | 110 | 79 | 68 |
| Lodgepole Pine | 120 | 64 | 53 |
| Lodgepole pine | 130 | 51 | 34 |
| Aspen | 110 | 93 | 71 |
| Aspen | 120 | 72 | 59 |
| Aspen | 130 | 60 | 43 |

EXAMPLE VI

The samples of Example V are tested for nail withdrawal resistance or nail holding power according to ASTM D-143. The results, shown as a percentage of the control samples (assumed to be 100%), are indicated in the following Table IV:

TABLE IV

| Species | Treatment Temp. (°C.) | Nail Withdrawal Resistance (% of Control) | |
|---|---|---|---|
| | | Heat Treated | Aldehyde Treated |
| Ponderosa pine | 110 | 98 | 102 |
| Ponderosa pine | 120 | 89 | 99 |
| Ponderosa pine | 130 | 91 | 96 |
| Lodgepole pine | 110 | 101 | 105 |
| Lodgepole Pine | 120 | 87 | 101 |
| Lodgepole pine | 130 | 89 | 95 |
| Aspen | 110 | 97 | 97 |
| Aspen | 120 | 94 | 102 |
| Aspen | 130 | 83 | 94 |

The samples are tested for abrasion resistance and no significant differences are noted between the heat treated and aldehyde treated samples.

EXAMPLE VII

Wood block samples having a size of 5 mm in the longitudinal or fiber direction and from 30 mm to 50 mm in the radial and tangential directions are prepared from air dried ponderosa pine, douglas fir, true fir, aspen, hemlock, redwood and lodgepole pine. Some of the samples are treated according to the procedure of Example III, while others are retained as controls. The samples are dried in a forced air oven at 105° C. for 24 hours and are weighed to determine an initial weight of the samples. The samples are then steam sterilized at 22 p.s.i. and 121° C. for 30 minutes in enclosed petri dishes.

Quart jars are filled with 260 g. of soil prepared according to ASTM Standard D-1413 and D-2017. A feeder block of ponderosa pine having a size of 55 mm in the longitudinal or fiber direction, 5 mm in the radial direction and 10 mm in the tangential direction is placed on the soil in each jar. The jars are fitted with lids having a ¾ inch cotton plugged hole and are steam sterilized at 22 p.s.i. and 121° C. for a period of 15 minutes. The feeder blocks are innoculated with pure cultures of the wood decay causing fungi *Lenzites trabea* (A), *Poria monticola* (B), or *Trametes hispida* (C) by placing 5 mm diameter pieces of the fungi on agar onto the feeder blocks. The fungi cultures are allowed to incubate at a temperature of 25° to 27° C. and a relative humidity of 65 to 75% for ten days.

The sterilized wood samples are then placed in the jars and allowed to incubate for 5 weeks at a temperature of 25° to 27° C. and a relative humidity of 65 to 75%. The wood samples are removed from the jars and the fungi mycellium is removed from the samples. The wood samples are again air dried in a forced air oven and weighted to determine a final weight of the samples. The percentage decay of the samples is calculated as:

$$\text{Decay (\%)} = \frac{(\text{Initial weight} - \text{Final weight}) \times 100}{\text{Initial weight}}$$

The results are shown in the following Table V:

TABLE V

| Species | Fungi | Wood Sample Decay (%) Control | Treated |
|---|---|---|---|
| Ponderosa pine | A | 27.51 | (1.43)* |
| Ponderosa pine | B | 3.15 | (1.69) |
| Hemlock | A | 26.32 | (0.84) |
| Lodgepole pine | A | 6.80 | 0.86 |
| True Fir | A | 23.16 | (4.00) |
| True Fir | B | 2.23 | (2.17) |
| Redwood | A | 1.29 | (1.09) |
| Douglas Fir | A | 13.98 | 1.87 |

*( ) indicates net weight gain due to some residual fungi mycellium.

EXAMPLE VIII

The procedure of Example VII is repeated except that the wood samples are incubated with the fungi in petri dishes on malt agar instead of in jars on soil. The results are shown in Table VI:

TABLE VI

| Species | Fungi | Wood Sample Decay (%) Control | Treated |
|---|---|---|---|
| Ponderosa pine | A | 14.20 | (1.70) |
| Ponderosa pine | B | 31.38 | (1.93) |
| Ponderosa pine | C | 15.10 | (7.20) |
| Hemlock | A | 14.96 | (1.59) |
| Hemlock | B | 14.88 | (2.11) |
| Aspen | A | 19.93 | (2.04) |
| Aspen | B | 18.18 | (2.19) |
| Aspen | C | 43.95 | (2.23) |
| Lodgepole pine | A | 19.20 | (0.60) |
| Lodgepole pine | B | 4.38 | (0.30) |
| True Fir | A | 14.21 | (1.73) |
| True Fir | B | 3.34 | (3.76) |
| Redwood | A | 10.23 | (0.72) |
| Redwood | B | 9.27 | (1.44) |
| Redwood | C | 6.15 | (1.52) |
| Douglas Fir | A | 12.12 | (4.64) |
| Douglas Fir | B | 35.65 | (3.54) |
| Douglas Fir | C | 2.78 | (1.84) |

EXAMPLE IX

Wood block samples are cut with flat (tangential) grain to a size of 8 inches high, 2.75 inches in width and ½ inch in thickness from ponderosa pine and yellow birch. A portion of the samples are subjected to the treatment of Example III. The samples are lightly sanded and stored at 19° C. and 54% relative humidity for a period of 120 hours to condition the wood. Various commercially available enamel, latex, polyurethane, varnish or stain coatings, with base coatings where applicable according to the manufacturer's application instructions, are applied to both treated and untreated (control) samples through a #50 nozzle at 10 p.s.i. A total of three coating layers is applied to the samples, which are allowed to air dry 24 hours between coatings and for a period of one week after the final coating. The samples are then subjected to accelerated weathering by a Weather-ometer DMC-R, a carbon-arc type light and water exposure apparatus, in a 24-hour cycle of 102 minutes only followed by 18 minutes of light and spray, repeated for a period of 18 hours at 19.5° C., followed by 6 hours without light or spray at 4.5° C. and 95±5% relative humidity. The foregoing cycle is repeated for a period of 14 days. At the end of the period, all of the treated samples remain flat whereas the untreated (control) samples exhibit a relatively high level of warpage and twisting. The coatings on the treated samples appear intact, substantially as they appeared prior to accelerated weathering. The coatings on the untreated samples all exhibit varying, but substantial, signs of weathering, including chalking, checking, cracking, erosion, blistering and/or flaking or scaling.

The inventive concepts have been described herein in connection with various illustrative, presently particularly preferred embodiments. Various modifications may be apparent from this description. Any such modifications are intended to be within the scope of the appended claims except insofar as precluded by the prior art.

What is claimed is:

1. A method of beneficiating wood, comprising contacting wood with an agent capable of forming a borate ester linkage between hydroxyl groups of the cell wall constituents of the wood, and thereafter contacting the wood with an aldehyde.

2. The method of claim 1 wherein the agent is selected from the group consisting of boric acid, lower polyalkyl borate esters, and mono- or di- substituted derivatives thereof.

3. The method of claim 2 wherein the agent comprises trimethyl borate.

4. The method of claim 1 wherein the aldehyde is selected from the group consisting of formaldehyde and acetaldehyde.

5. The method of claim 1 wherein the wood is contacted with the agent in a liquid phase.

6. The method of claim 5 wherein the agent comprises an aqueous solution of boric acid.

7. The method of claim 6 which further comprises drying the wood to a moisture content less than about 25% by weight prior to contacting the wood with the aldehyde.

8. The method of claim 5 wherein the agent comprises liquid trimethyl borate.

9. The method of claim 1 wherein the wood is contacted with the agent in a vapor phase.

10. The method of claim 9 wherein the agent comprises trimethyl borate.

11. The method of claim 9 or 10 wherein the wood is contacted with the agent by placing the wood and an open container of the agent in a closed vessel and the elevating of the temperature in the vessel.

12. The method of claim 11 wherein the temperature in the vessel is elevated to about 60° to about 140° C.

13. The method of claim 12 wherein the temperature in the vessel is elevated to about 110° to about 130° C.

14. The method of claim 12 which further comprises inducing a vacuum in the vessel prior to elevating the temperature of the vessel.

15. The method of claim 9 or 10 wherein the wood is contacted with the agent by placing the wood in a closed vessel and then introducing the agent in a vapor phase into the vessel.

16. The method of claim 1 or 4 wherein the wood is contacted with the aldehyde in a vapor phase.

17. The method of claim 16 wherein the wood is contacted with the aldehyde by placing the wood and an open container of the aldehyde in a closed vessel and then elevating the temperature in the vessel.

18. The method of claim 17 wherein the temperature in the vessel is elevated to about 60° to about 140° C.

19. The method of claim 18 wherein the temperature in the vessel is elevated to about 110° to about 130° C.

20. The method of claim 16 wherein the wood is contacted with the aldehyde by placing the wood in a closed vessel and then introducing aldehyde vapor into the vessel.

21. The method of claim 16 which further comprises removing at least a portion of any unreacting aldehyde from the wood after contacting the wood with the aldehyde.

* * * * *